US007093640B2

(12) United States Patent
Chandaria

(10) Patent No.: US 7,093,640 B2
(45) **Date of Patent: *Aug. 22, 2006**

(54) TAPE DISPENSER HAVING A RETAINING AND APPLICATION AREA

(75) Inventor: Ashok V. Chandaria, Nairobi (KE)

(73) Assignee: Kitaru Innovations, Inc., St. James (BB)

( * ) Notice: Subject to any disclaimer, the term of this patent is extended or adjusted under 35 U.S.C. 154(b) by 229 days.

This patent is subject to a terminal disclaimer.

(21) Appl. No.: 10/364,001

(22) Filed: Feb. 10, 2003

(65) Prior Publication Data

US 2004/0154750 A1 Aug. 12, 2004

(51) Int. Cl.
*B44C 7/02* (2006.01)

(52) U.S. Cl. ..... 156/527; 156/576; 156/579; 225/56; 225/77

(58) Field of Classification Search ..... 156/523, 156/574, 577, 579, 527, 576; 225/25, 39, 225/56, 77, 89, 91; D19/67, 69
See application file for complete search history.

(56) References Cited

U.S. PATENT DOCUMENTS 4,400,231 A * 8/1983 Martin ..... 156/527
4,630,765 A 12/1986 Samuelson et al.
4,780,172 A * 10/1988 Shea ..... 156/527
5,071,051 A * 12/1991 Corbo et al. ..... 225/65
5,468,332 A * 11/1995 Dretzka et al. ..... 156/527
5,672,238 A 9/1997 Samuelson
5,759,342 A 6/1998 Luhman et al.
5,820,005 A * 10/1998 Perkitny et al. ..... 225/65
5,972,475 A * 10/1999 Beekman ..... 428/167
6,874,554 B1 * 4/2005 Chandaria ..... 156/527

* cited by examiner

*Primary Examiner*—Mark A. Osele
(74) *Attorney, Agent, or Firm*—Sand & Sebolt

(57) ABSTRACT

A tape dispenser having a frame, a cutter blade and a non-rotatable pressure pad is disclosed. The dispenser holds a roll of adhesive tape therein. The cutter blade and pressure pad are secured together and are snap-fitted into the frame so that the blade extends a short distance beyond the front edge of the frame. The pressure pad applies pressure to the adhesive tape as it is being dispensed from the tape dispenser. The frame has side walls that each have a tab formed thereon. The tabs are positioned a short distance to the rear of the pressure pad and they do not extend below the lower edge of the side walls of the dispenser. The tabs are positioned and shaped in such a manner that tape from the roll is supported on the top surface of the tabs. The tape is biased into contact with the pressure pad by the tabs so that the tape is ready to be dispensed from the roll and is prevented from curling back onto the roll when cut.

36 Claims, 13 Drawing Sheets

SEE FIG-12

TAPE DISPENSER HAVING A RETAINING AND APPLICATION AREA

BACKGROUND OF THE INVENTION

1. Technical Field

This invention generally relates to tape dispensers. More particularly, the invention relates to hand-held tape dispensers adapted to dispense adhesive tape. Specifically, the invention relates to a hand-held tape dispenser that includes a tape retainer and a pressure pad for aiding in applying the adhesive tape to a surface and preventing the free end of the tape from curling back onto the roll held in the dispenser.

2. Background Information

There are numerous types of adhesive tapes that have a wide variety of uses. A frequently used type of adhesive tape is packaging tape that is used to secure the flaps of boxes and packages for shipping. This type of tape is typically 2 inches wide and is fairly difficult to pull off a roll by hand and manoeuver into position around a package. Large industrial hand-held tape dispensers have been proposed in the prior art for applying such wide adhesive tape. Many of these devices, however, experience a number of problems in their usage. Most adhesive tapes tend to be flimsy and easily statically charged so that when the tape is cut, the free end tends to curl back onto the roll of tape. One dispenser provided in the art is an industrial-use tape gun that includes a handle with a pivotable flap for keeping the free end of the tape biased onto a rotating roller to prevent the free end of the tape from curling back onto the roll. The flap keeps the free end of the tape locked against the roller when the dispenser is not in use. When the user wishes to apply tape to a second package, the roller is rotated across the second package's surface and the adhesive tape is thereby brought into contact with the second package's surface. While this device functions well, it is cumbersome to use and has a number of moving parts that make it expensive to manufacture and prone to breakage.

A second type of prior art device that clamps the free end of the tape is disclosed in U.S. Pat. No. 4,630,765, issued to Samuelson et al. This device relies on the cutting action of the dispenser to stick the free end of the tape to the "land area" 66 of the dispenser. The free end of the tape is then held in position by the top wall 80 of the dispenser. When the user next wishes to apply adhesive tape to a surface, the user pivots the top wall out of contact with the free end and then grasps the free end of the tape with their fingers and applies it to the surface to be taped.

Another type of dispenser, such as the disclosed in U.S. Pat. No. 5,672,238, issued to Samuelson, provides small tabs mounted on the frame of the dispenser to hold the free end of the tape off the roll. These dispensers require that the user position the free end of the tape onto the next package to the taped by way of their fingers. A common problem with these tabs is that they are fragile and tend to break off the frame relatively easily. They are therefore rendered useless fairly frequently.

A second problem experienced in the usage of previously known tape dispensers is that because adhesive tapes tend to be flimsy, if they are not immediately stuck down onto the surface they are being applied to, they tend to partially fold back on themselves. When pressure is applied to smooth out and stick the tape into contact with the surface, they tend to form small pockets of tape stuck to itself instead of to the surface to which the tape is being applied. This results in the surface having a messy appearance and in that less tape is in contact with the surface than may be desirable. This may result in a less secured package.

There therefore still exists the need in the art for a simple, effective adhesive tape dispenser that is adapted to be easily gripped in one hand, that allows the adhesive tape to be easily dispensed therefrom, that keeps the tape in a position where it is ready to be dispensed immediately and that allows the tape to be applied to a surface in a manner that results in the tape having a smooth and neat appearance.

SUMMARY OF THE INVENTION

The device of the present invention is a tape dispenser that has a frame, a cutter blade and a non-rotatable pressure pad. The dispenser holds a roll of adhesive tape therein. The cutter blade and pressure pad are secured together and are snap-fitted into the frame so that the blade extends a short distance beyond the front edge of the frame. The pressure pad applies pressure to the adhesive tape as it is being dispensed from the tape dispenser. The frame has side walls that each have a tab formed on their interior surface. The tabs are positioned a short distance to the rear of the pressure pad and they do not extend below the lower edge of the side walls of the dispenser. The tabs are positioned and shaped in such a manner that tape from the roll is supported on the top surface of the tabs. The tape is biased into contact with the pressure pad by the tabs so that the tape is ready to be dispensed from the roll and is prevented from curling back onto the roll when cut.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
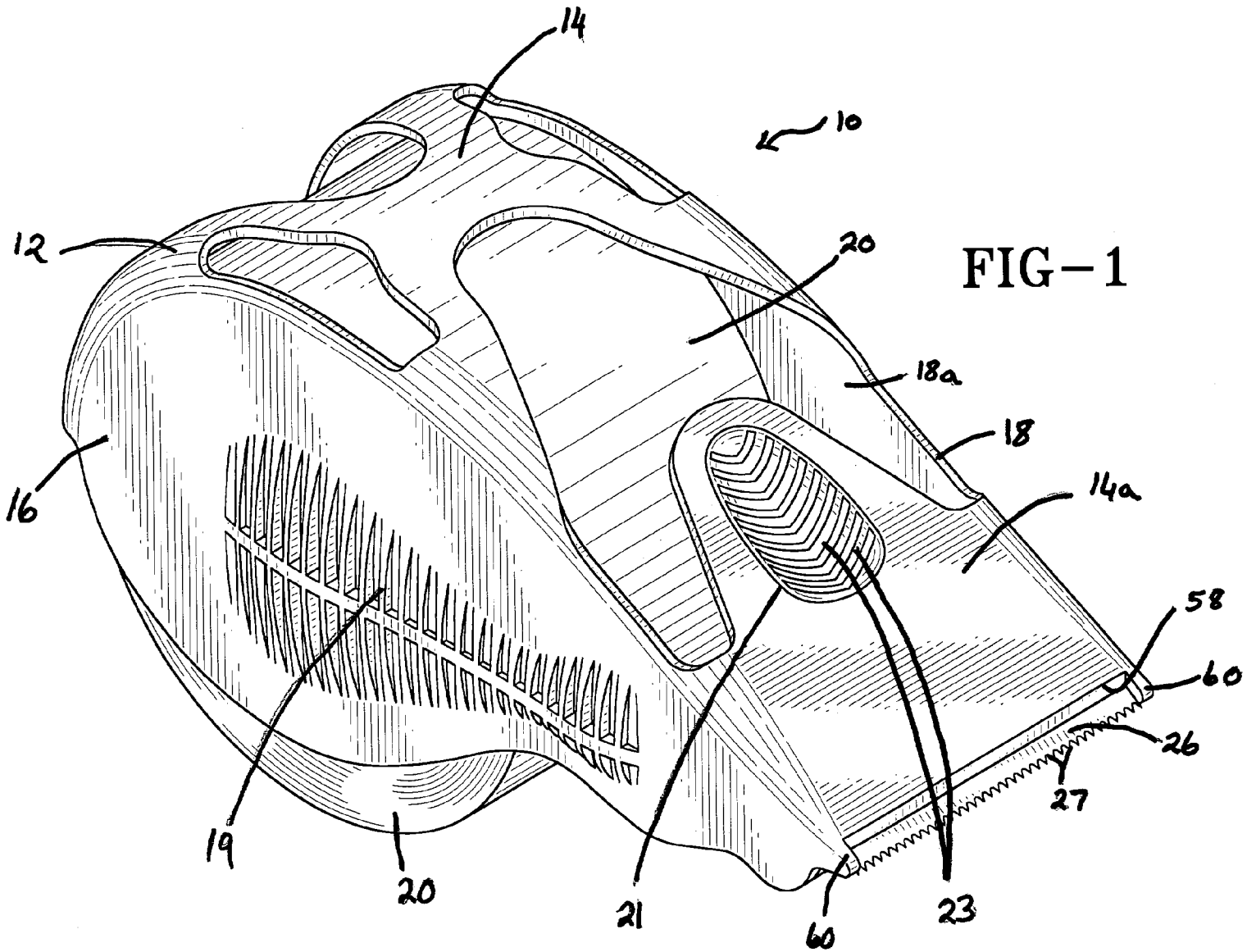
FIG. 1 is a perspective view of a tape dispenser in accordance with the present invention.
Figure 2:
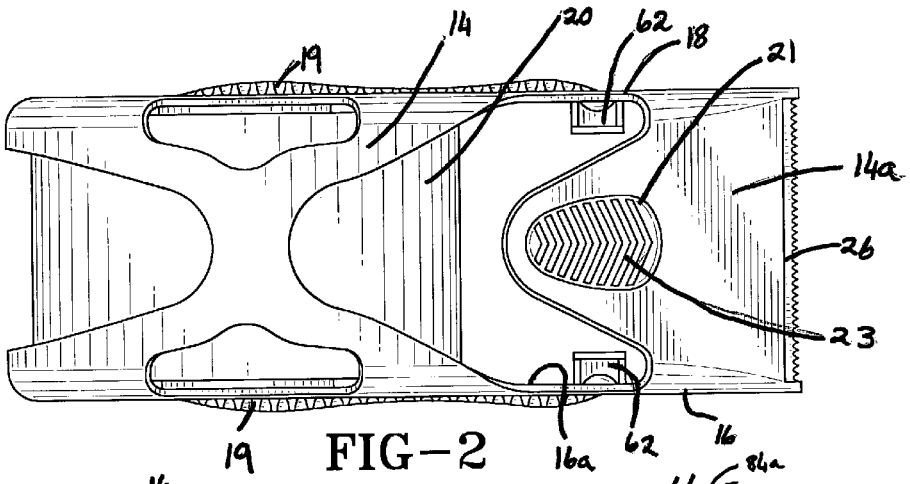
FIG. 2 is a top view of the tape dispenser of FIG. 1.
Figure 3:
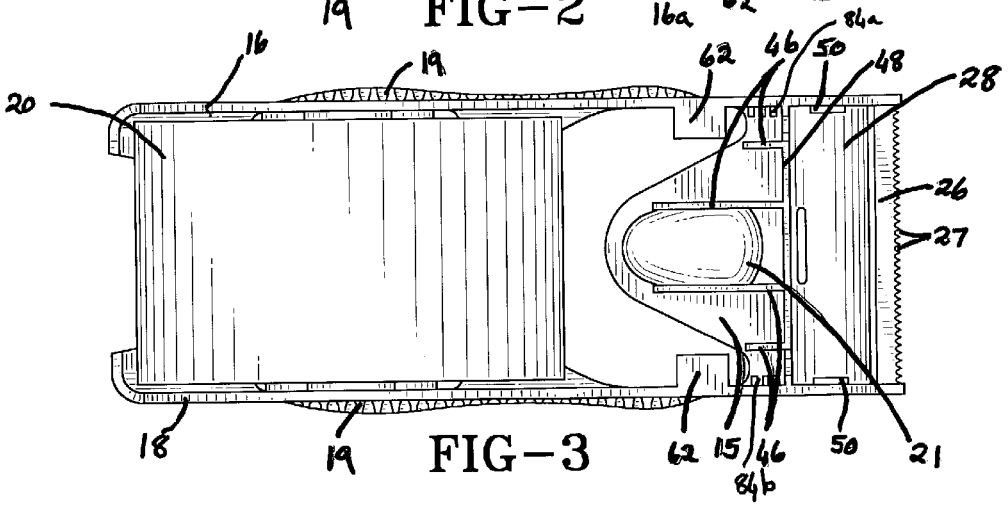
FIG. 3 is a bottom view of the tape dispenser of FIG. 1.
Figure 4:
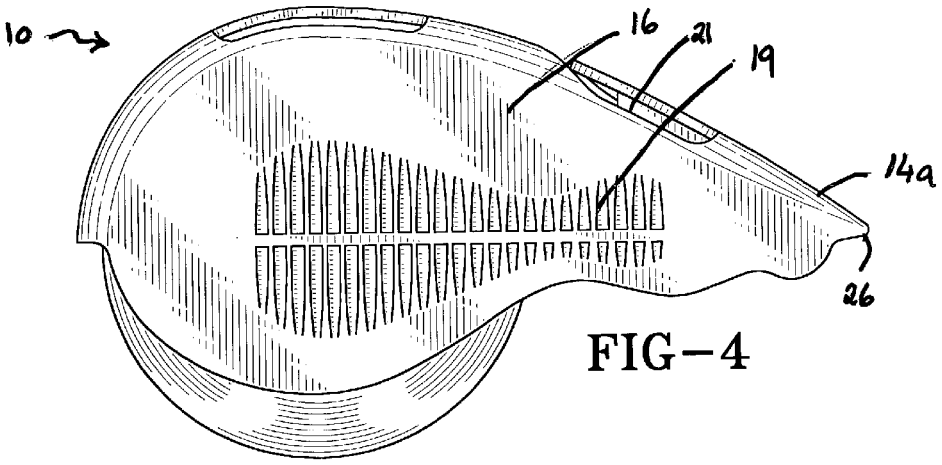
FIG. 4 is a left side view of the tape dispenser of FIG. 1.
Figure 5:
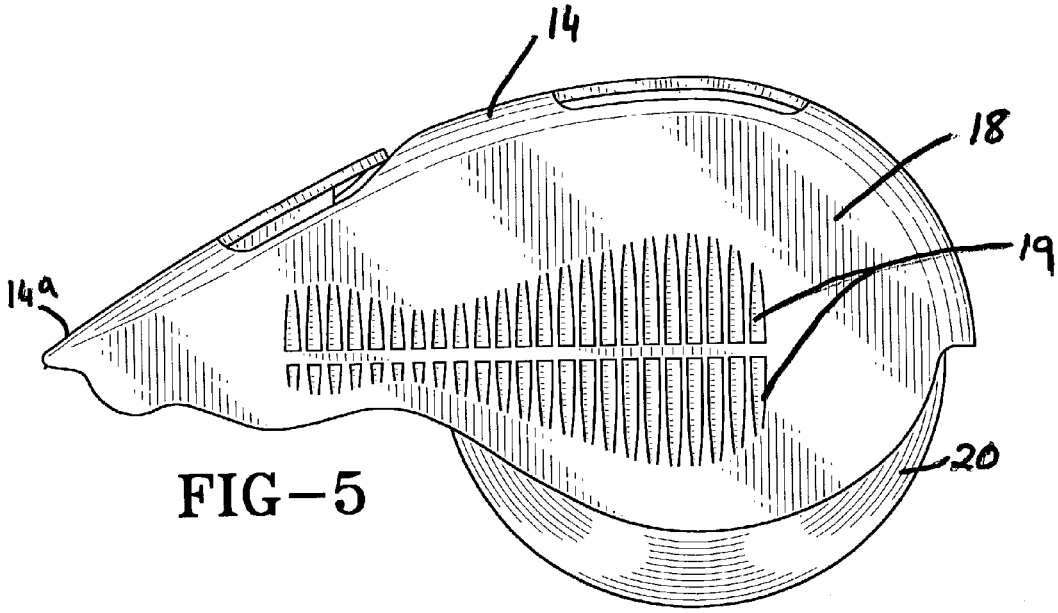
FIG. 5 is a right side view of the tape dispenser of FIG. 1.
Figure 6:
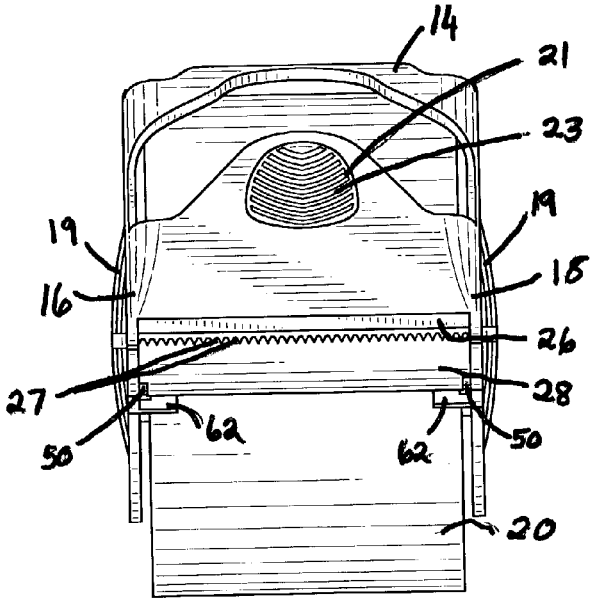
FIG. 6 is a front view of the tape dispenser of FIG. 1.
Figure 7:
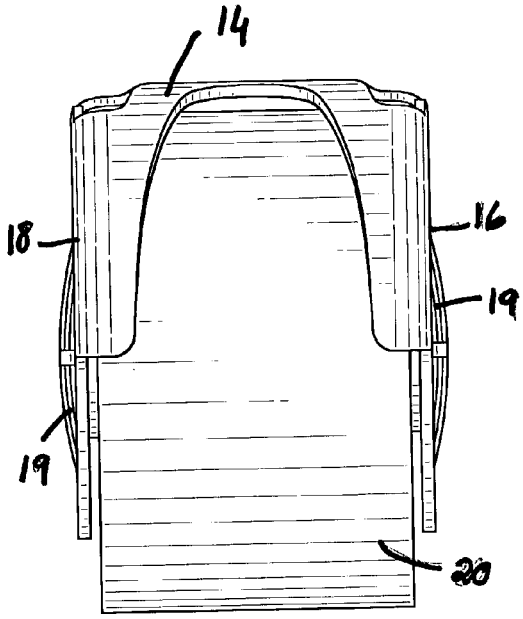
FIG. 7 is a rear view of the tape dispenser of FIG. 1.

Referring to FIGS. 1–7, there is shown a tape dispenser in accordance with the present invention, the dispenser being referred to generally by the number 10. Dispenser 10 comprises a frame 12 having an upper surface 14 and opposed side walls 16, 18. A roll 20 of adhesive tape 22 is held in position in dispenser 10 by way of hubs 24 (FIG. 9) extending from the opposed interior surfaces 16*a*, 18*a* of side walls 16, 18. A pressure pad, generally referred to by the number 28 (FIG. 6), and a cutter blade 26 with teeth 27 are provided proximate the front portion 14*a* of upper surface 14.

Dispenser 10 is molded from a suitable polymeric material that allows it to be manufactured reasonably cheaply but also be relatively strong and sturdy. Preferably, dispenser 10 is molded as an integral unit and side walls 16, 18 are preferably able to flex somewhat relative to each other so as to allow a roll 20 of tape to be inserted into dispenser 10. Upper surface 14 may either be molded as one solid piece (not shown) or be shaped in any desirable manner such as that shown in the attached figures. Additionally, a series of raised corrugations 19 may be molded in sides 16, 18 to allow the user to grip dispenser 10 more easily. Furthermore, upper surface 14 may be provided with a generally triangularly shaped recessed area 21 that is adapted to receive a fingertip (not shown) therein. Recessed area 21 is preferably provided with corrugations 23 that resist the sliding of any fingertip that may be placed therein.

Figure 8:
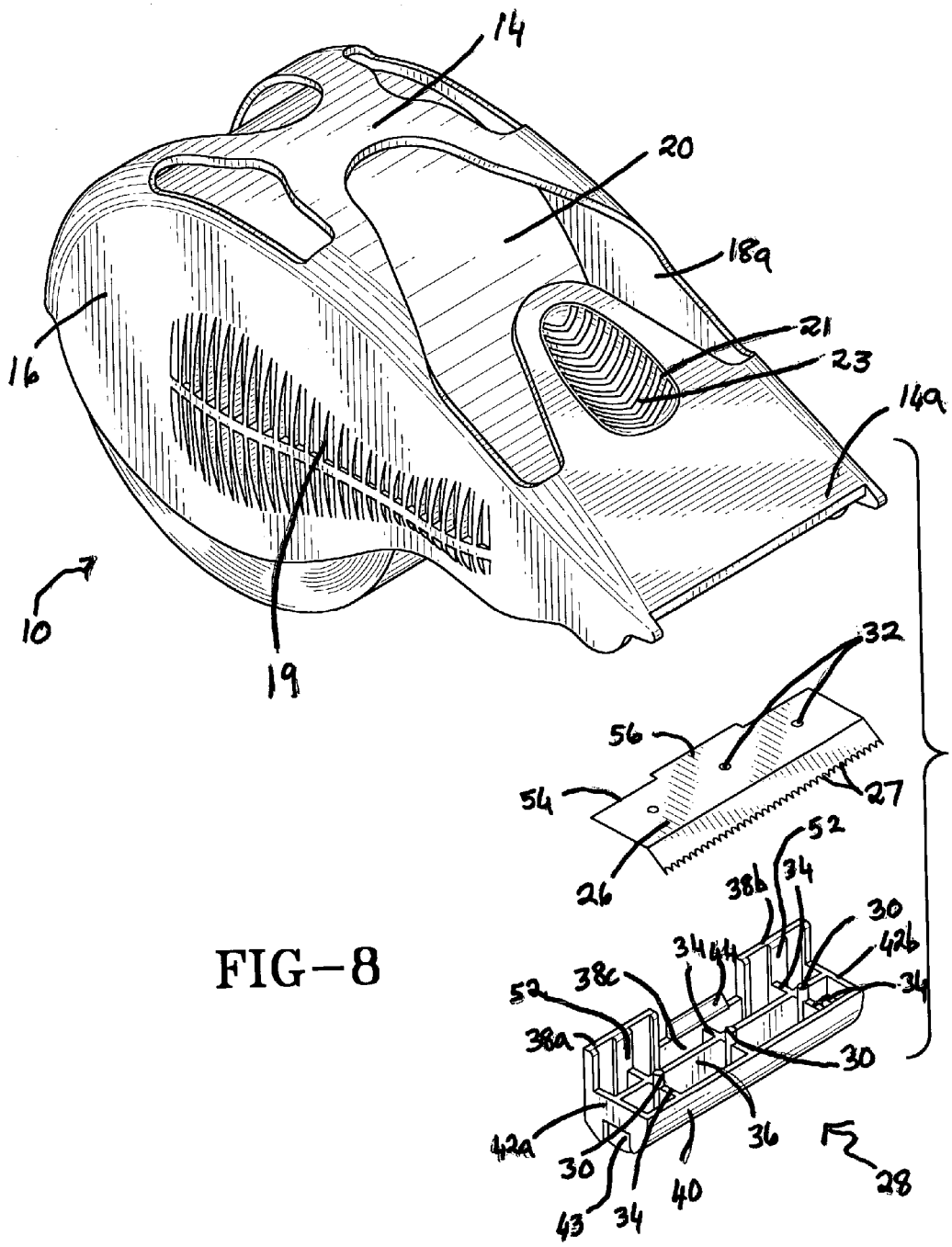
FIG. 8 is a partially exploded perspective view of the tape dispenser showing the relationship between the cutting blade and the pressure "foot"

Referring to FIG. 8, pressure pad 28 is preferably snap fitted into the interior of front portion 14*a*. Pressure pad 28 may, of course, be secured to front portion 14*a* of dispenser 10 in any other suitable manner, such as riveting, without departing from the scope of the present invention. The width of pressure pad 28 is configured to be received between side walls 16, 18 of dispenser 10. Pressure pad 28 has a rear wall 38 integrally formed with an arcuate front wall 40 and has two side walls 42*a*, 42*b* that are disposed substantially at right angles to rear wall 38. Side walls 42*a*, 42*b* may alternatively be disposed at either a greater or lesser angle relative to rear wall 38. In this instance, pressure pad 28 would either widen or narrow from the rear wall 38 toward the front wall 40. An angled pressure pad would be utilized in a tape dispenser that has either a wider or narrower front portion 14*a* relative to the area where the roll 20 of tape is secured. Side walls 42*a*, 42*b* each include a notched area 43. Rear wall 38 includes two upwardly extending outer sections 38*a*, 38*b* that are disposed on either side of a shorter intermediate section 38*c*. Outer sections 38*a* and 38*b* each include a projection 52 that slightly reduces the distance between transverse rib 36 and rear wall 38. The presence of the projection urges the cutter blade 26 into engagement with the pins 30. Intermediate section 38*c* further includes a hooked latch 44. Front wall 40 is preferably arcuate so as to allow it to glide easily over the surface to which adhesive tape 22 is to be applied. Front wall 40 may, however, be shaped in any other manner that will allow it to apply pressure to the tape 22 as it is being dispensed. For example, front wall 40 may be an open V-shape (not shown). In this configuration, one leg of the "V" could contact the tape as it is being applied to a surface and the apex of the "V" would be positioned so that it would not prevent the tape 22 from being cut by cutting blade 26. Pressure pad 28 further includes a transverse rib 36 and plurality of cross-ribs 34 for additional strength and rigidity. A plurality of pins 30 adapted to engage cutter blade 26 extend upwardly from cross-ribs 34. Pins 30 may however extend upwardly from transverse rib 36 or from the interior floor of the arcuate front wall 40.

Figure 10:
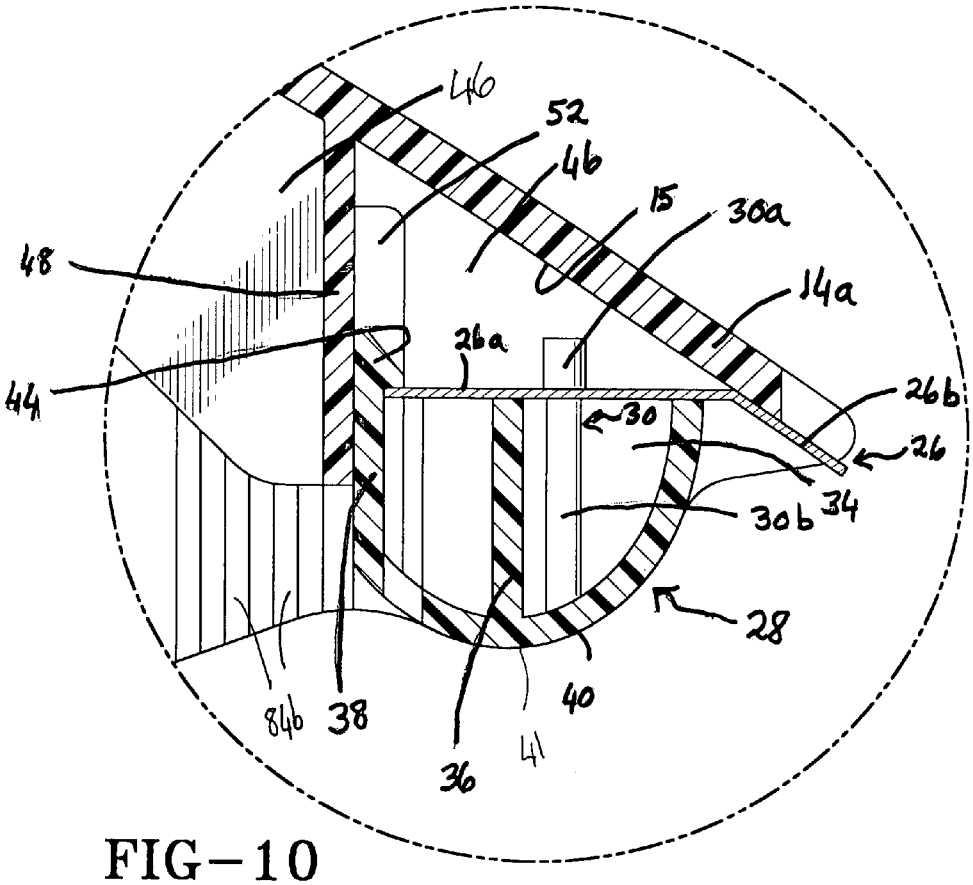
FIG. 10 is an enlargement of the highlighted area 11 from FIG. 9.
Figure 12:
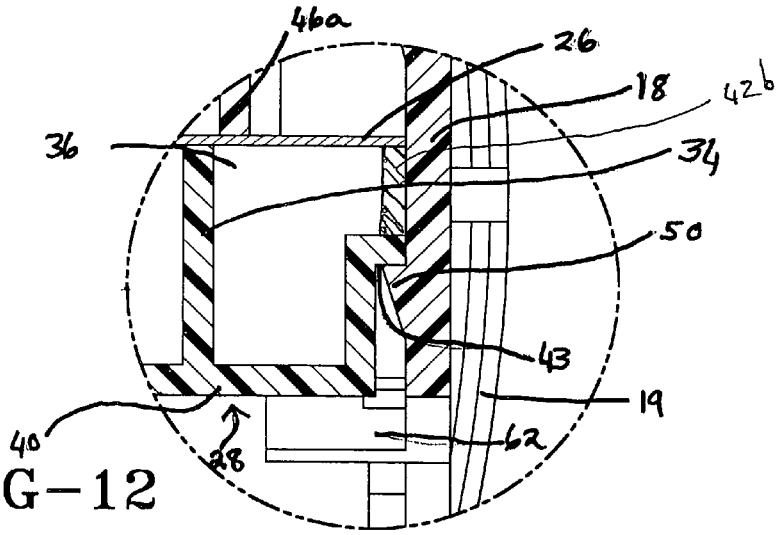
FIG. 12 is an enlargement of the highlighted area from FIG. 11.

Pressure pad 28 and cutter blade 26 are separate components, pressure pad 28 being manufactured from a polymeric material and cutter blade 26 being manufactured from metal. It will be understood by those skilled in the art, however, that pressure pad 28 and cutter blade 26 may be integrally molded from a polymeric material. In the preferred embodiment, pressure pad 28 and cutter blade 26 are connected together by a plurality of pins 30 that extend upwardly from pressure pad 28 through apertures 32 in cutter blade 26. As may be seen from FIG. 10, the diameter of upper ends 30*a* of pins 30 may be somewhat larger than the shafts 30*b* and of slightly greater diameter than the apertures 32. This allows the upper ends 30*a* of pins 30 to be received through apertures 32 to securely hold cutter blade 26 to pressure pad 28, but at the same time substantially prevents withdrawal of the pins 30 from apertures 32 without the application of some force. Additionally, the rear edge 54 of cutter blade 26 is shaped so that a small flange 56 (FIG. 8) extends therefrom. Flange 56 is configured to fit into intermediate section 38*c* of pressure pad 28. When cutter blade 26 is positioned so that pins 30 extend through apertures 32, flange 56 is clamped by latch 44 thereby preventing cutter blade 26 from being easily withdrawn from pressure pad 28.

As may be seen from FIGS. 3, and 9–12, the inner surface 15 of front portion 14*a* of dispenser 10 includes a plurality of longitudinal reinforcing ridges 46 and a transverse ridge 48. These ridges 46, 48 provide rigidity and strength to front portion 14*a*, but are also adapted to engage and support pressure pad 28. Ridges 46*a* that lie proximate side walls 16, 18 each include a small slot (not shown) for receiving one of the outer sections 38*a*, 38*b* of the rear wall 38 of pressure pad. The slots aid in preventing pressure pad 28 from sliding parallel to the longitudinal axis of dispenser 10 when it is in use. A boss 50 is disposed on each of the interior surfaces 16*a*, 18*a* of side walls 16, 18. As may be seen in FIG. 12, boss 50 is wider at one end so that it is able to engage notch 43 and prevent pressure pad 28 from being easily withdrawn. The combination of inner surface 15 of front portion 14*a*, the side walls 16, 18, ridges 46 and transverse ridge 48 form a pocket for receiving pressure pad 28. Side walls 16, 18 must be slightly flexed apart in order for the unit of the pressure pad 28 and cutter blade 26 to be received in this pocket. Pressure pad 28 is snap fitted into the pocket so that rear wall 38 of pressure pad abuts transverse ridge 48 and the side walls 42 of pressure pad abut side walls 16, 18 of dispenser 10. When pressure pad 28 is secured into place, the teeth 27 and a small section of cutter blade 26 extend beyond the front edge 58 of front portion 14*a*. As may be seen from FIG. 10, cutter blade 26 has a first section 26*a* that rests on and is secured to pressure pad 28. Cutter blade 26 further has a second section 26*b* that is angled with respect to the first section 26*a*. The angle of second section 26*b* is configured to be such that when pressure pad 28 and cutter blade 26 are connected to dispenser 10, second section 26*b* abuts the inner surface 15 of front portion 14*a*. Small extensions 60 project from front portion 14*a* on either side of cutter blade 26 so as to reduce the possibility of the user cutting themselves on cutter blade 26.

Disposed a short distance (in the order of 0.5 inches or less) rearward of transverse ridge 48, there are two tabs 62, each tab being integrally formed with the interior surface 16*a*, 18*a* of one of the side walls 16, 18. Tabs 62 extend a short distance into the gap between side walls 16 and 18. They are adapted to support the tape 22 as it is being dispensed and they support the free end 22*a* of the tape 22 when the dispenser 10 is not in use.

Figure 9:
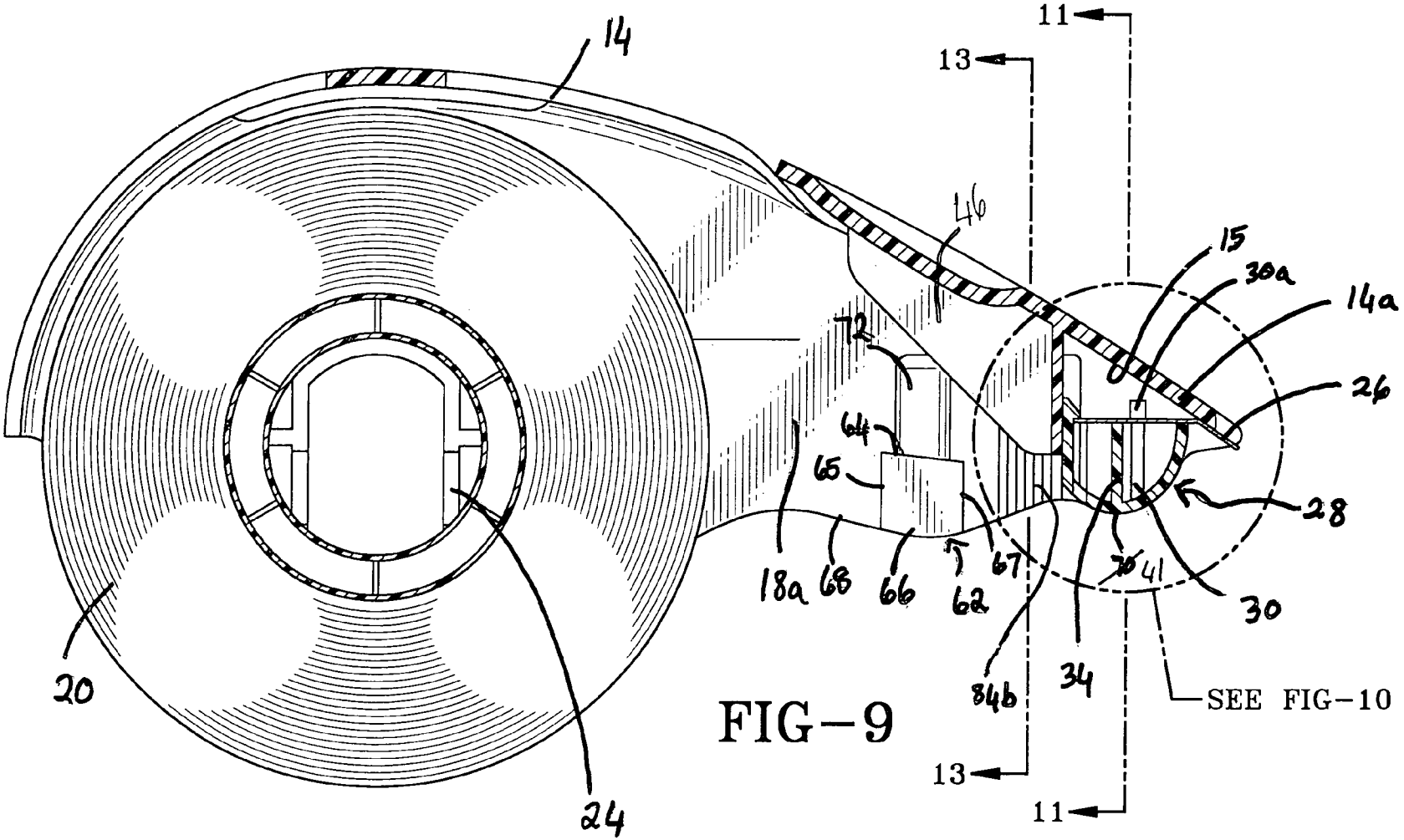
FIG. 9 is a cross-sectional side view of the tape dispenser illustrating the relationship between tape guides, the projections upon which the tape guides are mounted, the pressure foot and the cutting blade.
Figure 13:
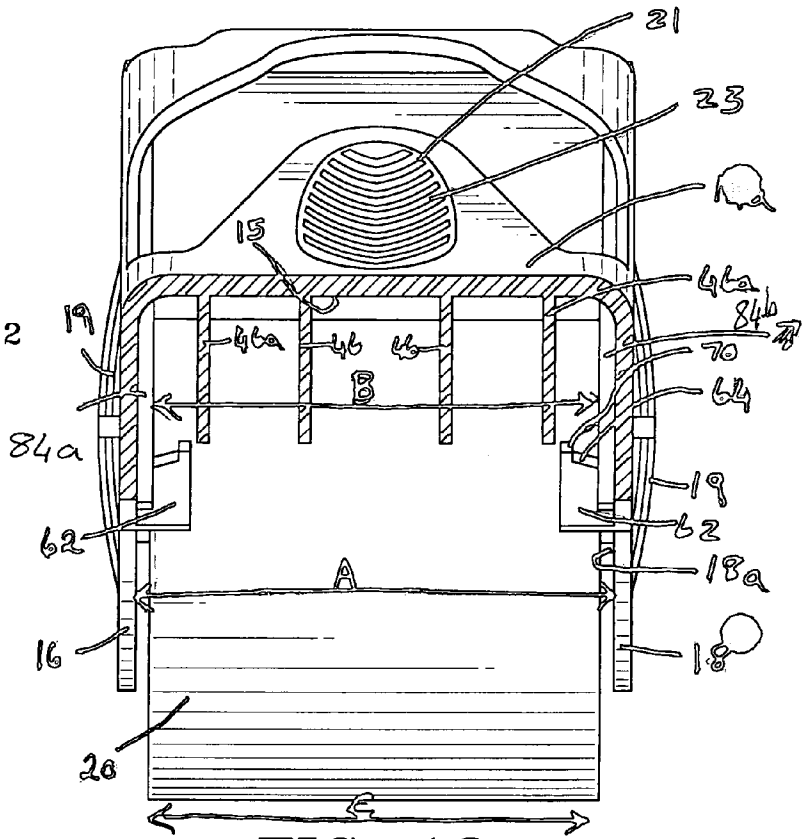
FIG. 13 is a cross-sectional view of the tape dispenser through 13—13 of FIG. 9.
Figure 11:
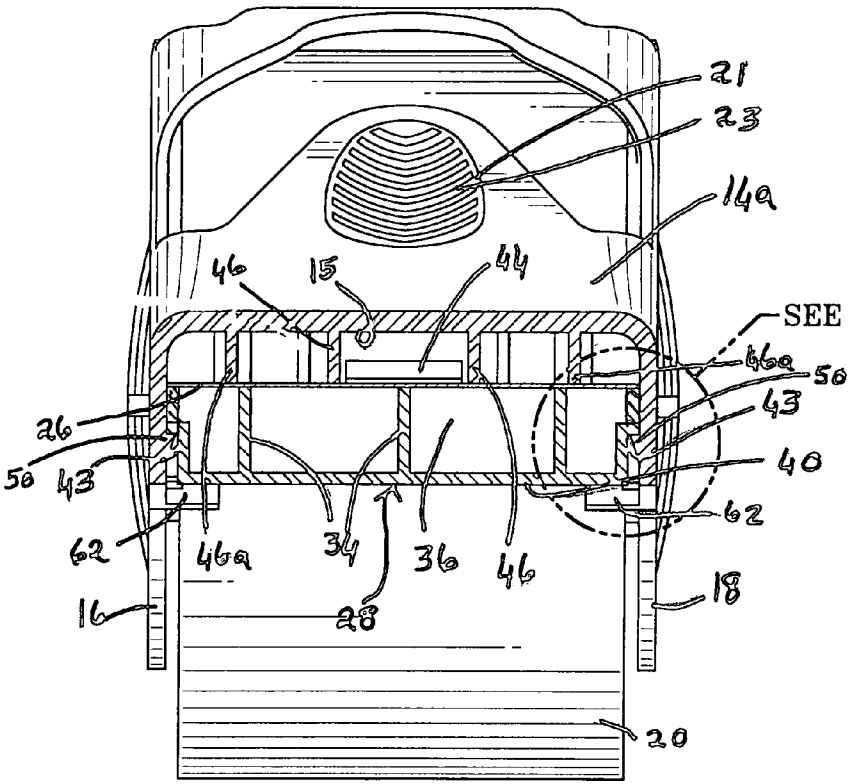
FIG. 11 is a partial cross-section front view of the tape dispenser.
Figure 14:
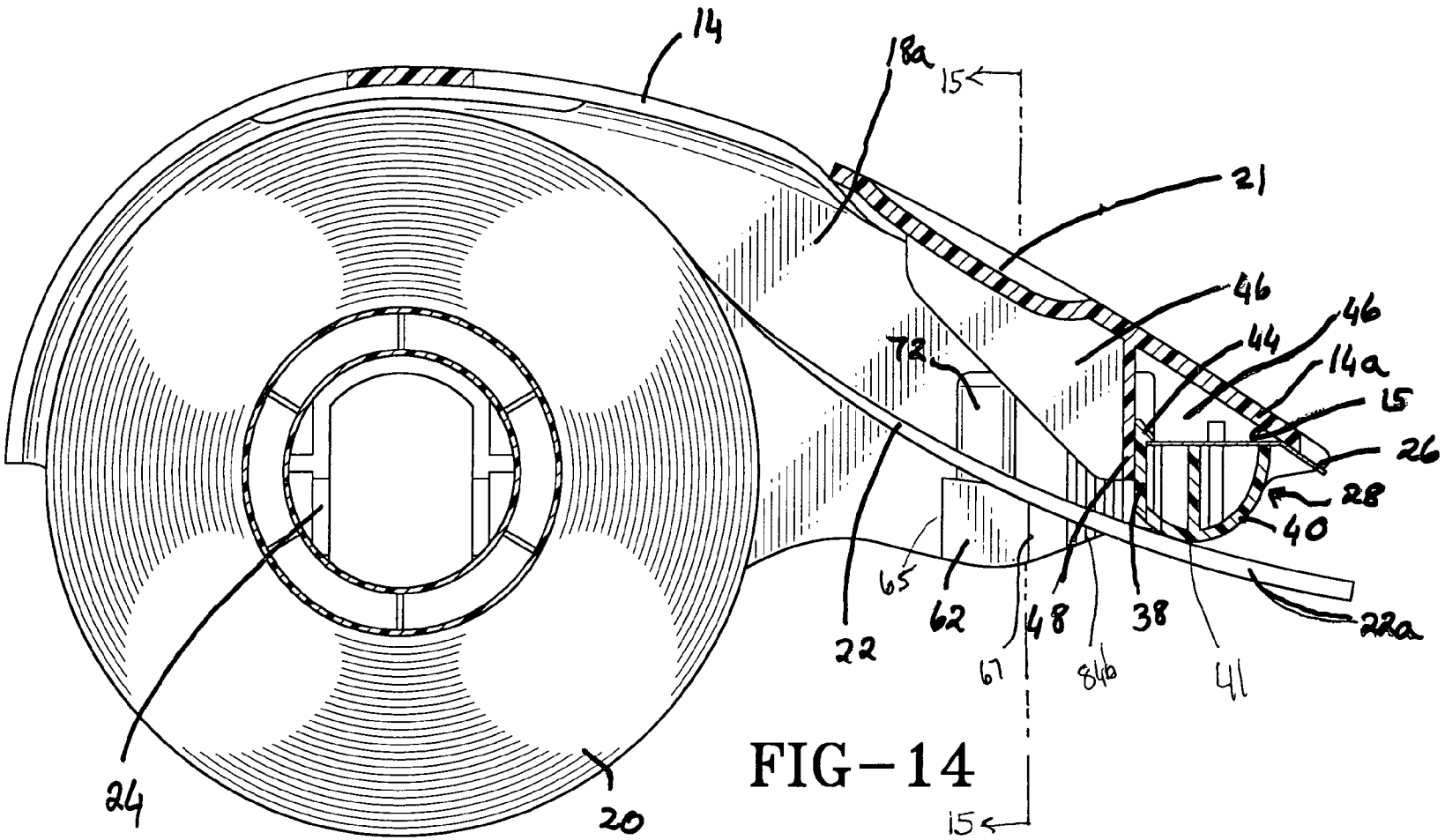
FIG. 14 is a cross-sectional side view of the tape dispenser illustrating the path tape takes through the dispenser.

The following describes the tab disposed on the interior surface 18*a* of side wall 18, but it will be understood that the tab on interior surface 16*a* of side wall 16 is similarly shaped and functions in the same manner. Referring to FIG. 9, tab 62 has a top surface 64, a bottom surface 66, a back 65 and a front 67. Top surface 64 is inclined from the back 65 to the front 67 of tab 62 and angles downwardly toward the lowermost point 70 of pressure pad 28. Bottom surface 66 of tab 62 is preferably flush with the lower edge 68 of side walls 16, 18. Tab 62 may alternatively be spaced a small distance inwardly from lower edge 68 so that a gap exists between bottom surface 66 and lower edge 68. Alternatively, tab 62 may be positioned so that bottom surface 66 extends a very small distance below lower edge 68. It will, however, be understood by those skilled in the art that substantially all of tab 62 lies inwardly of lower edge 68 of side walls 16, 18. This protects tab 62 from being easily broken off dispenser 10 during normal operation because the side wall 18 shield the tab 62 from impact. As may be seen from FIG. 13, top surface 64 may include a lip 70. Furthermore, top surface 64 is inclined at an acute angle to the interior surface 18*a* of side wall 18 so that surface 64 slopes generally downwardly toward lower edge 68 from lip 70.

Figure 15:
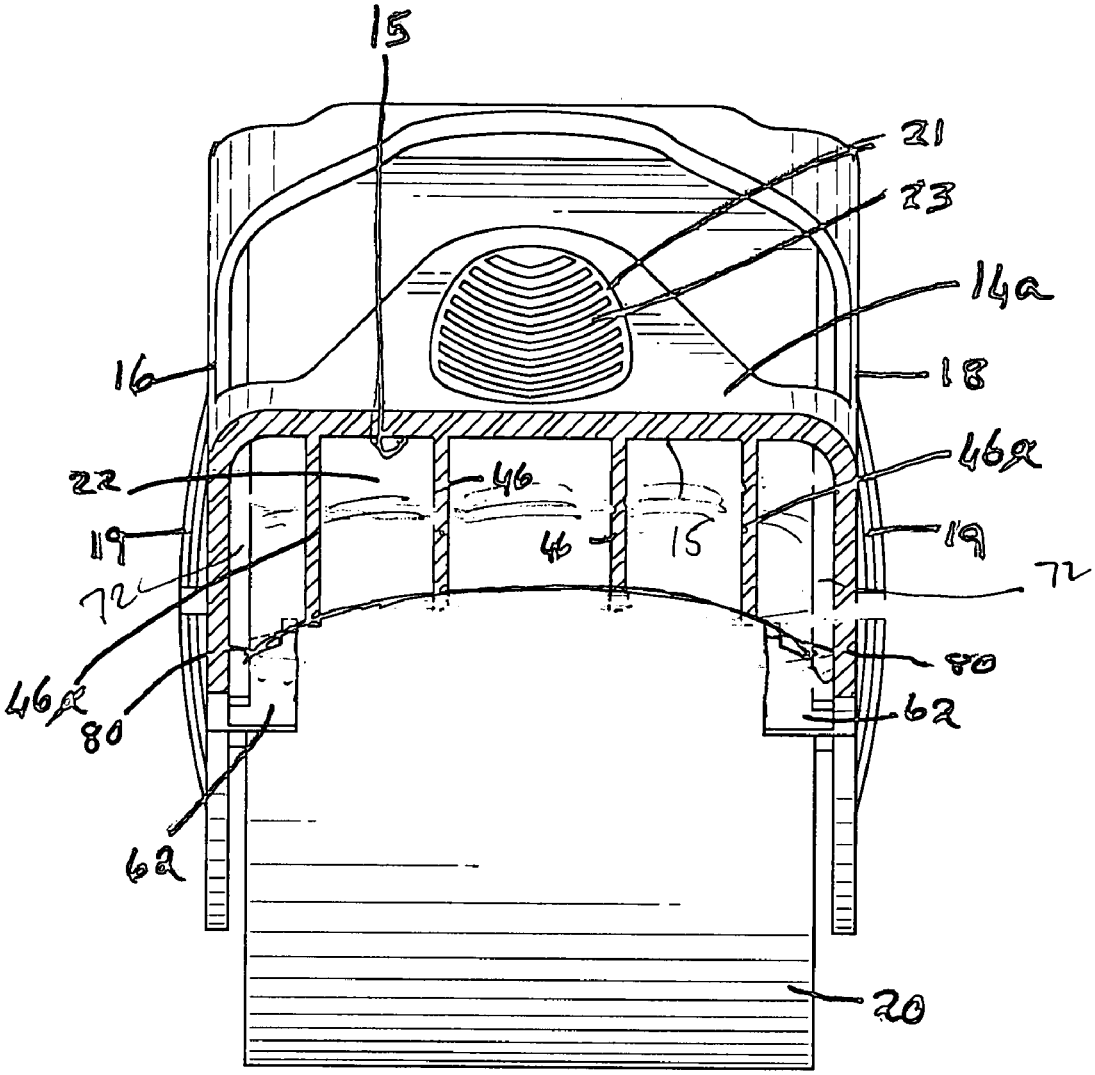
FIG. 15 is a cross-sectional front view of the tape dispenser through 15—15 of FIG. 14.
Figure 16:
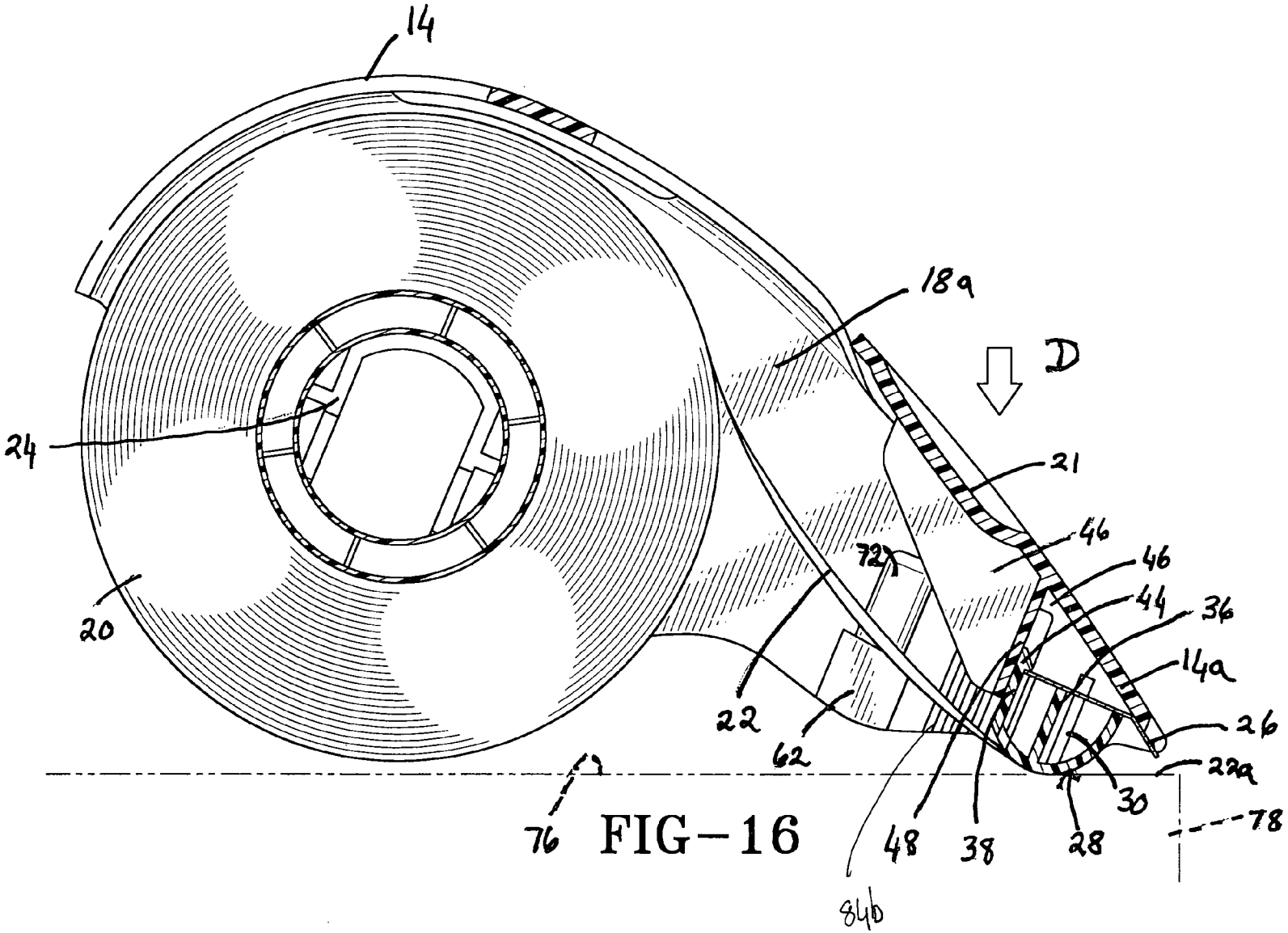
FIG. 16 is a cross-sectional side view showing the initial position of a tape dispenser prior to the tape being dispensed therefrom.
Figure 17:
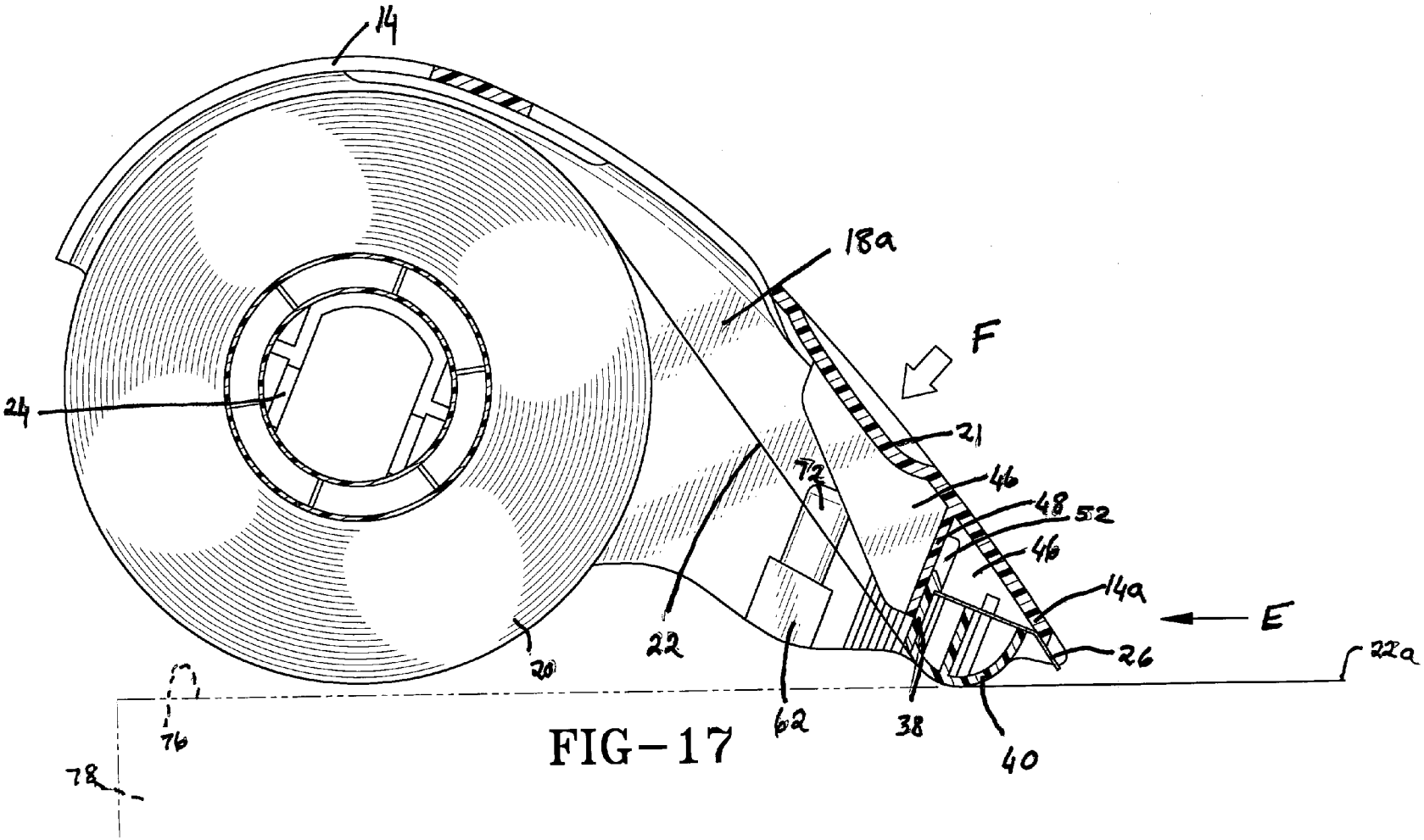
FIG. 17 is a cross-sectional side view of the tape dispenser dispensing tape onto a surface.
Figure 18:
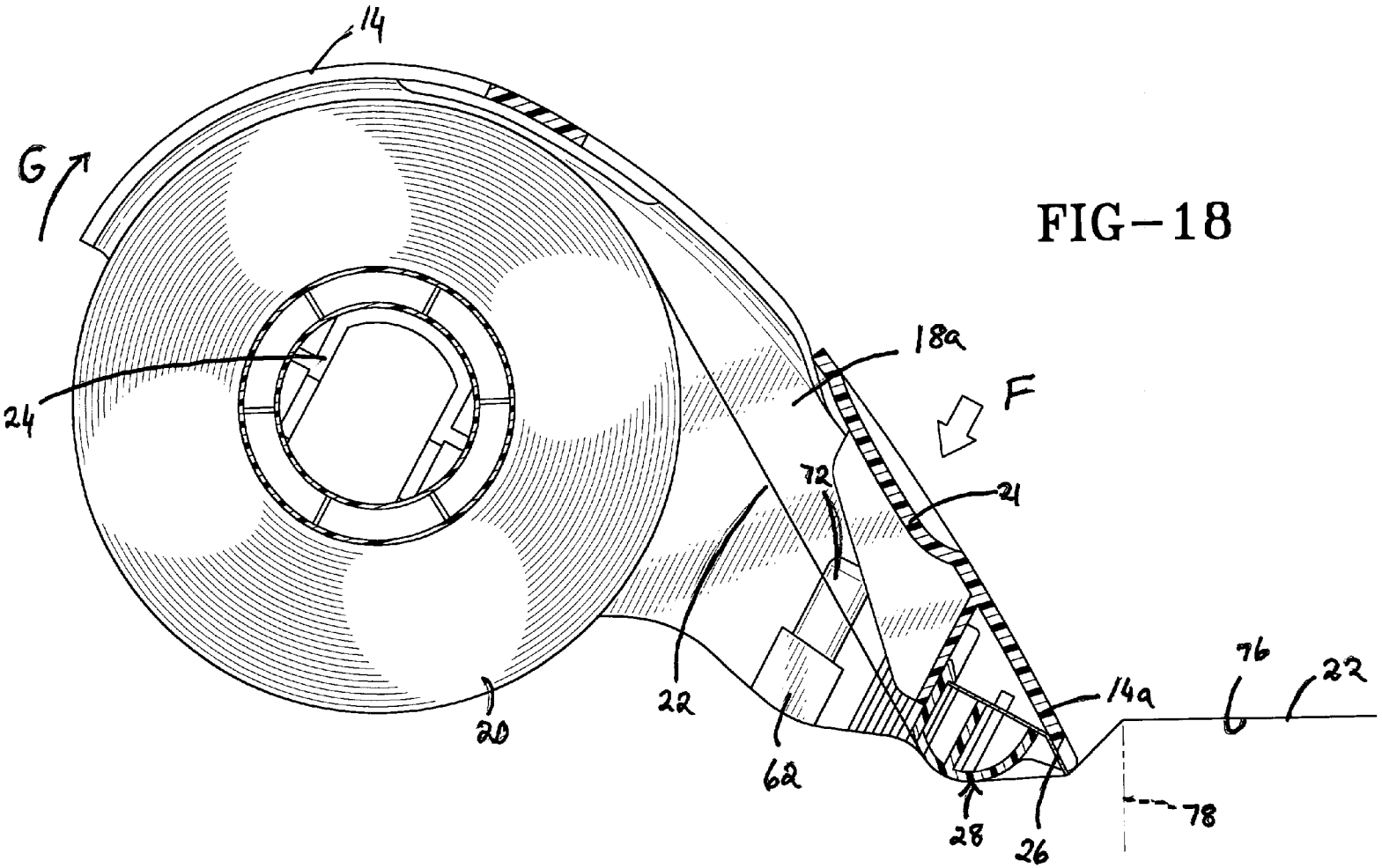
FIG. 18 is a cross-sectional side view of the tape dispenser prior to cutting of the tape.
Figure 19:
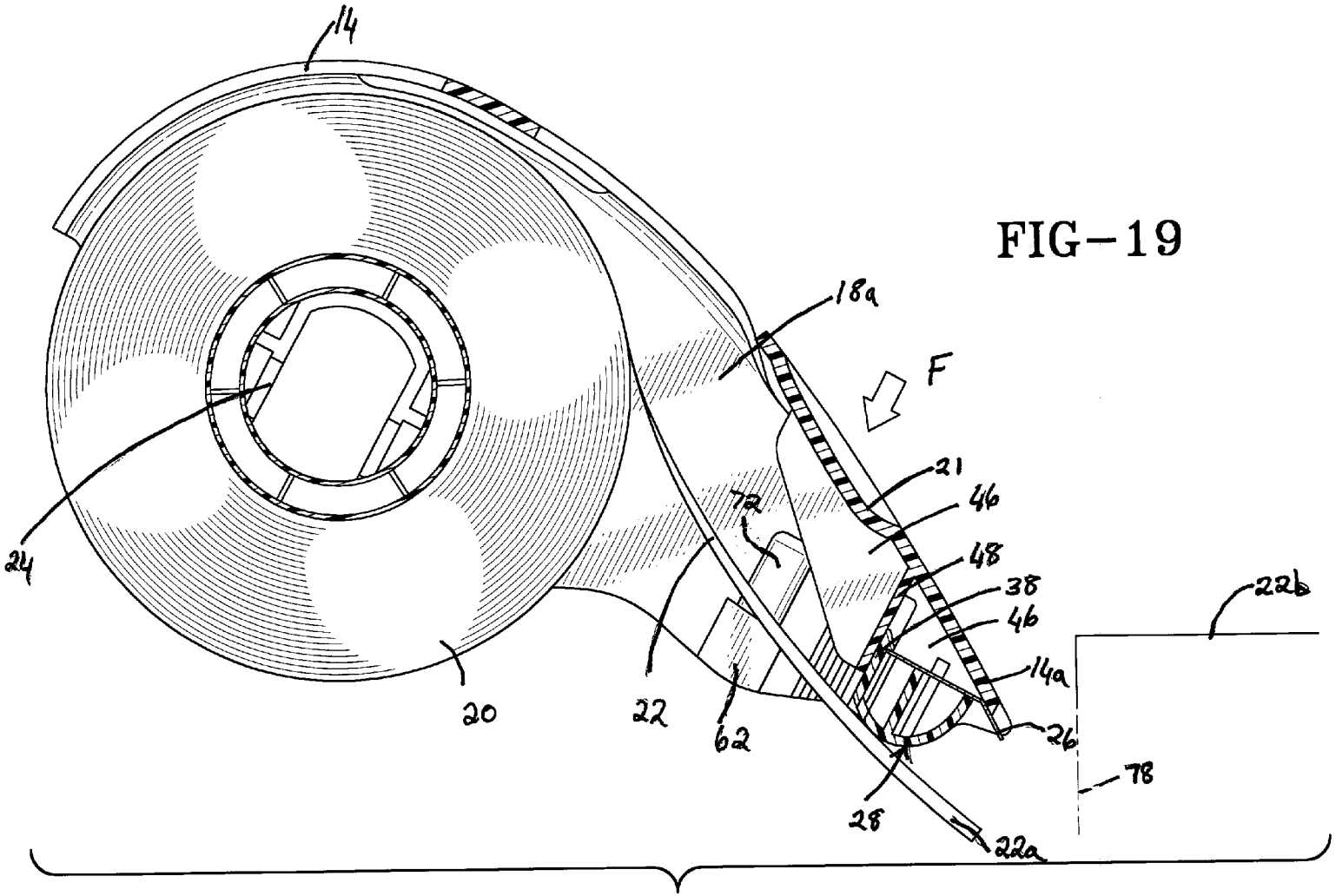
FIG. 19 is a cross-sectional side view of the tape dispenser immediately after the tape has been cut and the free end of the tape is being held ready in a position for dispensing.

A projection 72, disposed on interior surface 18*a*, extends from top surface 64 toward the interior of upper surface 14 of dispenser. The distance between side walls 16 and 18 may be represented by the letter A. The distance between the projection 72 on side wall 18 and projection 74, may be represented by the letter B. Distance B is shorter than distance A. Additionally, distance B is slightly less than the width C of the tape 22 on roll 20. Dispenser 10 is adapted to hold tape 22 from the roll 20 so that the tape 22 is supported by tabs 62 in such a manner that the side edges 80 of the tape 22 extend over the top surface 64 of the tabs 62 and contact the projections 72, 74. This causes the tape 22 to assume a convexly-arched shape as may be seen in FIG. 15. The shape of tape 22 is produced by the combination of the angle of the top surface 64 of tabs 62 being downwardly sloped toward the interior surface 18*a* of side wall 18, the top surface 64 being sloped downwardly from back 65 to front 67 and toward pressure pad 28 as well as the reduced distance B between interior surfaces 16*a* and 18*a*. The shape of the tape 22 assists in preventing the free end 22*a* of tape 22 from curling back onto roll 20. The slight convex arch in the tape 22 also biases the tape 22 into contact with pressure pad 28, thereby holding free end 22*a* ready for application to a new surface.

A plurality of ridges 84*a*, 84*b* are disposed on the interior surfaces 16*a*, 18*a* of side walls 16, 18. Ridges 84 project inwardly and the distance between ridges 84*a*, 84*b* is approximately the same as the distance between projections 72. Ridges 84*a*, 84*b* aid in maintaining the convex profile of tape 22 so that tape 22 is urged into contact with pressure pad 28.

Referring to FIGS. 14 through 19, in operation, the free end 22*a* of the tape 22 is threaded over tabs 62 and under pressure pad 28. Free end 22*a* is brought into contact with a surface 76 (FIG. 16) of a package 78 to be taped. Front portion 14*a* of dispenser 10 is pushed downwardly in the direction of arrow D so that pressure pad 28 urges free end 22*a* into contact with surface 76. The adhesive on tape 22 secures free end 22*a* to surface 76 as pressure is continued to be applied in the direction of arrow D. Dispenser 10 is then moved in the direction of arrow E while pressure continues to be applied in the direction of arrow F. This maintains the contact between pressure pad 28 and tape 22 while allowing tape to be dispensed from roll 20. The continuous pressure from pressure pad 28 smooths the tape 22 out as it is dispensed, thereby substantially preventing the tape 22 from sticking to itself and forming pockets that cannot be secured to surface 76. When it is desired to cut the tape 22, pressure in the direction of arrow F is maintained on the dispenser 10 so that tape 22 is held taut. Dispenser 10 is rotated upwardly in the direction of arrow G so that teeth 27 of cutter blade 26 contact and cut tape 22. The severed tape 22*b* remains stuck to package 78 and tape 22 drops back into engagement with tabs 62. Free end 22*a* remains biased to pressure pad 28 and is in position for immediate application to a second package (not shown). 26 and pressure pad 28 form a unit that is snap-fitted into frame 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A tape dispenser comprising:

a frame having an upper surface and opposed side walls; each of the side walls having a lower edge;

a tape mount disposed on an interior surface of each of the side walls and being adapted to secure a roll of tape therebetween;

a cutter blade disposed on the frame and adapted to cut tape from the roll;

a tab disposed on the interior surface of each of the side walls substantially inwardly above of the lower edge thereof; and wherein the tab has an upper surface;

a non-rotatable pressure pad mounted on the frame adjacent the cutter blade; the pressure pad having a bottom surface; and wherein the tabs lay adjacent the pressure pad; and the upper surface of the tab is substantially coplanar with the bottom surface of the pressure pad so that tape from the roll is biased into contact with the pressure pad; and wherein the bottom surface of the pressure pad is adapted to push tape from the roll into contact with a surface to which the tape is being applied as the tape is dispensed.

2. A tape dispenser as set forth in claim 1, wherein the tabs are positioned less than 0.5 inches rearwardly of the pressure pad.

3. A tape dispenser as set forth in claim 1, wherein each of the tabs has a top surface, a bottom surface, a back and a front, and the bottom surface of each tab is substantially flush with the lower edge of its respective side wall and when tape from the roll is received on the tabs, the tape rests on the top surface of the tabs whereby the tape is held a distance inwardly of the lower edges of the side walls.

4. A tape dispenser as set forth in claim 3, wherein the bottom surface of each tab is disposed above the lower edge of its respective side wall, whereby a gap is formed between the lower edge and the bottom surface of the tab.

5. A tape dispenser as set forth in claim 4, wherein substantially all of the tab lies above the lower edge of the side wall.

6. A tape dispenser as set forth in claim 3, wherein the pressure pad is disposed between the cutter blade and the tabs and in close proximity to both the cutter blade and the tabs: and wherein the top surface of the tab is inclined downwardly from the back of the tab toward the front of the tab.

7. A tape dispenser as set forth in claim 6, wherein the top surface of the tab is disposed at an acute angle with respect to the interior surface of the side wall of the dispenser.

8. A tape dispenser as set forth in claim 7, wherein the top surface of the tab includes a lip and the top surface angles downwardly from the lip toward the interior surface of the side wall of the dispenser.

9. A tape dispenser as set forth in claim 1, wherein the pressure pad includes a rear wall, a front wall adapted to contact tape from the roll and side walls connecting said front wall and rear wall.

10. A tape dispenser as set forth in claim 9, wherein the pressure pad further includes at least one cross-rib connecting the rear wall to the front wall.

11. A tape dispenser as set forth in claim 10, wherein the pressure pad further includes a transverse rib connecting the side walls together, said transverse rib intersecting said cross-rib.

12. A tape dispenser as set forth in claim 1, further comprising:

a projection disposed on the interior surface of each side wall, whereby the distance between the projections is less than the distance between the interior surfaces of the side walls.

13. A tape dispenser as set forth in claim 12, wherein the projections are disposed approximately 0.5 inches rearwardly of the pressure pad.

14. A tape dispenser as set forth in claim 12, wherein the projections are adapted to bias the tape into contact with the pressure pad.

15. A tape dispenser comprising:

a frame having an upper surface and opposed side walls with a lower edge;

a tape mount disposed on said frame and adapted to secure a roll of tape therein;

a cutter blade disposed on said frame and adapted to cut tape from the roll;

a tab disposed on the interior of each of the side walls, each tab having a top surface;

a projection disposed on the interior of each side wall, said projection extending upwardly from the top surface of the tab toward the upper surface of the dispenser; and a non-rotatable pressure pad mounted on the frame between the cutter blade and the tab, and wherein the pressure pad lies inwardly of the lower edge of the frame and the projection biases tape from the roll of tape into contact with a bottom surface of pressure pad; and wherein the bottom surface of the pressure pad is adapted to push tape from the roll into contact with a surface to which the tape is being applied as the tape is dispensed.

16. A tape dispenser as set forth in claim 15, wherein the projection is disposed proximate the tab on the interior of the respective side walls.

17. A tape dispenser as set forth in claim 16, wherein the distance between the projections is less than the distance between the interior surfaces of the side walls.

18. A tape dispenser as set forth in claim 17, wherein the tabs are adapted to hold tape from the roll thereon such that the edges of the tape extend over the top surface of the tabs and contact the projections, whereby the tape is caused to assume a convexly-arched shape when viewed from the front of the dispenser.

19. A tape dispenser as set forth in claim 18, wherein the projections are adapted to bias the tape into contact with the pressure pad.

20. A tape dispenser comprising:

a frame;

a tape mount disposed on said frame, the tape mount being adapted to secure a roll of tape therein;

a cutter blade disposed on said frame and adapted to cut tape from the roll;

a non-rotatable pressure pad mounted on the frame, the pressure pad being adapted to push tape from the roll into contact with a surface to which the tape is being applied as the tape is dispensed; and wherein the pressure pad includes a rear wall;

a front wall adapted to contact tape from the roll; and side walls connecting said front wall and rear wall;

at least one cross-rib connecting the rear wall to the front wall; and a transverse rib connecting the side walls together, said transverse rib intersecting said cross-rib; and wherein the rear wall of the pressure pad has two outermost sections and an intermediate section disposed between the outermost sections, the intermediate section being of reduced height relative to the outermost sections.

21. A tape dispenser as set forth in claim 20, wherein the intermediate section further includes a latch that extends toward the front wall of the pressure pad.

22. A tape dispenser as set forth in claim 21, wherein the pressure pad and the cutter blade engage each other and are connected together.

23. A tape dispenser as set forth in claim 22, wherein the cross-rib of the pressure pad includes at least one pin that extends from one of the front wall, cross-rib and transverse rib.

24. A tape dispenser as set forth in claim 23, wherein the cutter blade defines an aperture and the pin from the pressure pad is receivable within said aperture.

25. A tape dispenser as set forth in claim 24, wherein the pin has a shaft and the shaft has an uppermost end, the uppermost end of the shaft being of greater diameter than the shaft and being of slightly greater diameter than the aperture, whereby the uppermost end is receivable through said aperture but substantially prevents withdrawal of the pin from the aperture.

26. A tape dispenser as set forth in claim 25, wherein the cutter blade has a rear edge and a flange extends from the rear edge, the flange being configured to be received within the intermediate section of the rear wall of the pressure pad.

27. A tape dispenser as set forth in claim 26, wherein the latch on the intermediate section is adapted to engage the flange on the cutter blade so as to substantially prevent the cutter blade from being withdrawn attachment to the pressure pad.

28. A tape dispenser as set forth in claim 27, wherein the side walls of the dispenser include a boss and the side walls of the pressure pad include a notch and the boss is engageable with the notch to secure the pressure pad between the side walls of the dispenser.

29. A tape dispenser as set forth in claim 28, wherein the upper surface of the dispenser has an inner surface and the inner surface includes at least one axially aligned ridge.

30. A tape dispenser as set forth in claim 29, wherein the inner surface includes a plurality of spaced apart, axially aligned ridges, and the ridges lying proximate the side walls of the dispenser each include a slot, each slot being configured to receive one of the outermost sections of the rear wall of the pressure pad.

31. A tape dispenser as set forth in claim 30, wherein the inner surface of the upper surface further includes at least one transverse ridge extending between the side walls of the dispenser, said transverse ridge intersecting said axially aligned ridge.

32. A tape dispenser as set forth in claim 31, wherein the upper surface of the dispenser further includes a front edge and the pressure pad is received between the front edge and the transverse ridge.

33. A tape dispenser as set forth in claim 32, wherein the pressure pad is snap fitted between the front edge and the transverse ridge.

34. A tape dispenser as set forth in claim 33, wherein the pressure pad is snap-fitted into the dispenser in a position that allows at least a portion of the cutter blade to extend beyond the front edge.

35. A tape dispenser as set forth in claim 34, wherein the cutter blade includes:

a first portion that rests upon and is connected to the pressure pad; and a second portion that is angled with respect to the first portion, the second portion being configured to abut the inner surface of the upper surface of the dispenser.

36. A tape dispenser as set forth in claim 35, wherein the pressure pad is integrally formed with the cutter blade.

* * * * *